United States Patent [19]

von Raven et al.

[11] Patent Number: 5,039,377

[45] Date of Patent: Aug. 13, 1991

[54] BLEACHING PAPER PULP WITH MODIFIED SILICATE ION EXCHANGER AND HYDROGEN PEROXIDE

[75] Inventors: Axel von Raven, Seeshaupt; Josef Weigl, Munich; Friedrich Ruf, Tiefenbach; Herbert Mayer, Kleinberghofen, all of Fed. Rep. of Germany

[73] Assignee: Süd-Chemie, Aktiengesellschaft, Munich, Fed. Rep. of Germany

[21] Appl. No.: 527,532

[22] Filed: May 23, 1990

Related U.S. Application Data

[63] Continuation-in-part of Ser. No. 274,914, Nov. 22, 1988, abandoned.

[30] Foreign Application Priority Data

Nov. 23, 1987 [DE] Fed. Rep. of Germany ..... 3739655

[51] Int. Cl.[5] ..... D21C 9/16

[52] U.S. Cl. ..... 162/78; 162/80; 8/111

[58] Field of Search ..... 162/80, 90, 78; 8/111

[56] References Cited

U.S. PATENT DOCUMENTS

| | | | |
|---|---|---|---|
| 3,650,887 | 3/1972 | Grangaard | 162/78 |
| 4,623,357 | 11/1986 | Urban | 252/186.43 |
| 4,751,023 | 6/1988 | Stehlin et al. | 252/558 |

OTHER PUBLICATIONS

Ali et al. "The Role of Silicate in Peroxide Brightening of Mechanical Pulp" Journal of Pulp & Paper Science vol. 12, No. 6, Nov. 1986.

*Primary Examiner*—Karen M. Hastings
*Attorney, Agent, or Firm*—Herbert P. Price

[57] ABSTRACT

A method for bleaching pulp using an alkaline, peroxide-containing bleaching agent for chemical pulp, mechanical pulp, waste paper and/or mixtures thereof, which optionally contains water glass and/or a complexing agent, contains, as an additive, a silicate ion exchanger which has been modified using an alkali metal carbonate or alkali metal hydrogen carbonate.

9 Claims, No Drawings

BLEACHING PAPER PULP WITH MODIFIED SILICATE ION EXCHANGER AND HYDROGEN PEROXIDE

CROSS REFERENCE TO RELATED PATENT APPLICATIONS

This is a continuation in part of application, Ser. No. 07/274,914, filed Nov. 22, 1988, now abandoned.

BACKGROUND OF THE INVENTION

The invention relates to an additive to an alkaline peroxide-containing bleaching agent for chemical pulp, mechanical pulp, waste paper and/or mixtures thereof, and to a bleaching agent of this type and to a bleaching process.

Bleaching is intended reliably to produce high final brightnesses with the lowest possible investment cost, a minimum of running costs and, as far as possible, no disadvantageous side effects.

In contrast to chemical pulp bleaching, only lignin-preserving bleaching is in principle suitable for brightening mechanical pulp, be it in the form of groundwood, pressure groundwood, refiner mechanical pulp, thermomechanical or chemico-thermomechanical pulp and waste paper. The bleaching agent usually used is hydrogen peroxide ($H_2O_2$) In the production of chemical pulp, lignin-removing bleaching with oxygen and/or hydrogen peroxide is also used.

The brownish yellow color of mechanical pulp is caused essentially by lignins, lignin-like phenols and extracts, and degradation products thereof, which form chromophoric systems due to the presence of conjugated double bonds and auxochromic groups. The increase in the brightness without delignification requires specific destruction of the chromophoric systems with a minimum of pulp extraction, since organic substances present in the bleaching medium will increase the chemical oxygen demand (COD).

Brightening processes in lignin-preserving bleaching and their mechanisms are not yet precisely known in detail.

Hydrogen peroxide decomposes by two reaction mechanisms. In the case of homolytic decomposition, which can be represented by the equation $$H_2O_2 \rightarrow 2HO \rightarrow H_2O + O_2 \quad (1),$$

hydroxide free radicals are firstly formed and react via a chain reaction to form the decomposition products, water and oxygen. This reaction, which is exothermic per se, is normally prevented by the high activation energy for cleavage of the oxygen-oxygen bond in $H_2O_2$. However, it can be catalyzed, in particular by heavy metals and compounds thereof, which are frequently present in bleaching liquids. Homolytic decomposition can thus become the major reaction. This is, however, not desirable since this reaction course causes oxidative damage and only has little bleaching effect in the desired sense. In order to prevent this reaction, the presence of peroxide stabilizers and complexing agents in the bleaching process is regarded as being necessary.

The desired reaction of hydrogen peroxide is the dissociation in water in accordance with the equation $$H_2O_2 + H_2O \rightleftharpoons HO_2^- + H_3O^+ \quad (2),$$

The equilibrium constant for this reaction at room temperature is $1.78 \times 10^{-12}$. The perhydroxide anion ($HO_2^-$), which is generally regarded as a bleaching reagent, is of importance here. Its concentration can be increased by increasing the $H_2O_2$ concentration or by adding alkali and trapping the acid. The latter is the procedure generally carried out, and one speaks of activation of the hydrogen peroxide.

If stabilizers are not used in the case of lignin-removing bleach containing $H_2O_2$ in alkali medium, it is not only perhydroxide anions which form from hydrogen peroxide, but also HO free radicals in accordance with equation (1) and further peroxide free radicals, which may, under certain circumstances, result in high-energy singlet oxygen. Traces of heavy metals, in particular, are effective here, which means that it is important that they are eliminated.

The technological requirements for bleaching can thus be summarized as follows:

1. Bleaching activation by means of alkali

The correct ratio between hydrogen peroxide and alkali is very important, this ratio being temperature dependent. Both in lignin-preserving and lignin-removing bleaching, the amount of alkali must be matched to the amount of hydrogen peroxide employed. The degree of loading of the circulation water is also dependent on this. In the case of water glass stabilized groundwood bleach and during deinking, an initial pH of from 10.5 to 11 is usually established. The brightness maxima are shifted towards larger amounts of alkali introduced (primarily sodium hydroxide) as the amounts of hydrogen peroxide increase. The view hitherto was that peroxide bleaching is inadequately activated at low alkali metal hydroxide concentrations.

2. Stabilization of the hydrogen peroxide

In order to prevent formation of hydroxide free radicals in accordance with equation (1), various stabilizers have already been used.

(a) Water glass

The reaction mechanism of stabilization of hydrogen peroxide by water glass in alkaline solution has still not been clarified to date. The reason for this is probably the colloid-chemical processes, which are difficult to quantify. The water glass probably also binds heavy metals. Furthermore, stabilization using water glass is important in combination with magnesium ions in groundwood bleach. In addition to its stabilizing action, water glass also acts as an alkali donor and buffer substance and as a wetting agent and dispersant. Furthermore, it is inexpensive to employ.

Due to some disadvantages, which will be discussed in greater detail below, there has been no lack of attempts to replace or supplement water glass by other substances.

(b) Complexing agents

The attempt to reduce the amount of water glass used has resulted in the use of complexing agents. In general, compounds which complex heavy metals are used for this purpose. Amongst inorganic chelating agents, polyphosphates, primarily sodium tripolyphosphate, are of importance. Organic complexing agents are primarily polyhydroxycarboxlic acids (for example gluconic acid), aminopolycarboxylic acids (for example nitrilotriacetic acid = NTA, ethylenediaminetetraacetic acid = EDTA, and diethylenetriaminopentaacetic acid = D-

TPA) and polyphosphonic acids (ATMP, EDMP and DTPMP).

In contrast to free heavy-metal ions, complexed heavy-metal ions are no longer capable of breaking down hydrogen peroxide catalytically in accordance with equation (1).

The disadvantageous effects on the bleaching process and the paper manufacturing process by the bleaching conditions which are necessary today can be summarized as follows:

1. Effect of Alkali

The most important chemical in groundwood and waste paper bleaching and for good removal of printing ink, and thus for greatest possible brightening of the fibrous materials, is sodium hydroxide. This action is counteracted by alkali yellowing, which is in some cases irreversible depending on the treatment conditions.

Furthermore, the COD value is an essentially linear function of the NaOH concentration, i.e. the content of organic substances in the bleaching medium increases with increasing NaOH concentration. A high COD load requires an increased consumption of hydrogen peroxide and reduces the strength properties of the fibrous materials. In addition, a high COD load acts as an "interfering substance" due to undesired interactions with cationic auxiliaries, whose activity is impaired. Moreover, production interferences may occur due to increased deposits.

2. Effects of water glass

Since water glass is alkaline, the disadvantageous effects mentioned for alkali arise in principle. In addition, production interferences can occur, caused, for example in the presence of alkaline earth metal ions, by precipitation of alkaline earth metal silicates. Furthermore, hydrolytic reactions of water glass result in the formation of deposits on pipes, cells, suction rolls, screens, calendars, etc., and finally, the action of retention and flocculation agents is impaired, which results in lower effectiveness and increased consumption of the chemicals.

3. Effect of hardness elements

Since calcium carbonate is employed in large amounts in the paper industry as a filler and coating pigment, carbonate hardnesses of 100° (German) and greater occur in the paper making factories, depending on whether the circuit is closed. The $CA^{+2}$ ions dissolved in the circulation water impair the bleaching action of the hydrogen peroxide since they consume both water glass and complexing agents, meaning that they are no longer capable of forming complexes with any heavy metals, which causes undesired decomposition of peroxide in accordance with equation (1). If the amount of complexing agent present is less than stoichiometric relative to polyvalent metal ions, precipitation of carbonates and insoluble salts of the complexing agents with the hardness elements of the water can occur. This precipitation can result in considerable production interference.

SUMMARY OF THE INVENTION

The object of the invention is as far as possible to reduce or even to avoid the use of alkalis, water glass and/or complexing agents in the bleaching of chemical pulp, mechanical pulp, waste paper and/or mixtures thereof, and nevertheless to obtain products of comparable or even greater brightness.

The invention thus relates to an additive to an alkaline, peroxide-containing bleaching agent for chemical pulp, mechanical pulp, waste paper and/or mixtures thereof, which optionally also contains water glass and/or a complexing agent, and is characterized in that it is a water-insoluble inorganic silicate ion exchanger which has been modified with an alkali metal carbonate or alkali metal hydrogen carbonate.

DESCRIPTION OF THE INVENTION

In contrast to experience hitherto, bleaching with hydrogen peroxide with addition of only small amounts of alkali metal hydroxide, or none at all, i.e., in the neutral to slightly alkaline pH range, and with addition of only small amounts of water glass, or none at all, or with addition of only small amounts of complexing agents, or none at all, can be achieved by adding the modified silicate ion exchanger, the fibrous products obtained having high brightnesses. Furthermore, relief of the circuit from interfering substances through adsorption is achieved in addition to a lower water circuit load (COD load) by addition of the modified ion exchangers. However, better bleaching results when the modified silicate ion exchangers are used in combination with alkali, water glass or complexing agents, which may be used in smaller amounts than hitherto.

On the basis of investigations hitherto, the following functions in hydrogen peroxide bleaching can be described to the modified silicate ion exchangers;

1. activation of the hydrogen peroxide, even in the neutral or slightly alkaline pH region, which was not foreseeable per se from equation (2);
2. preferential ion exchange or adsorption of heavy metal ions with a decomposing effect, which means that the use of complexing agents and/or water glass is no longer necessary or only in lower concentration that hitherto;
3. absorption of organic "interfering substances", which adversely affect the bleaching result.

The following advantages arise from the full or partial omission of alkali metal hydroxide, water glass and complexing agents:

1. prevention of irreversable alkali yellowing;
2. prevention of high COD loads and secondary reactions thereof, such as, for example, increased consumption of hydrogen peroxide, strength impairment, activity impairment of cationic chemical auxiliaries, production interferences by deposits;
3. prevention of activity impairment of retention and flocculation agents by water glass;
4. prevention of silica precipitation from the water glass on suction rolls, screens, etc.;
5. prevention of precipitation of insoluble salts of hardness elements with complexing agents.

In the bleaching agent additive according to the invention, the silicate ion exchanger is preferably modified by charging with 1 to 70, in particular 5 to 50, percent by weight, based on the total additive, of alkali metal carbonate or alkali metal hydrogen carbonate.

The silicate ion exchanger (i.e., the non-carbonate or non-hydrogen carbonate component) preferably has a BET surface area of at least 30 $m^2/g$ and a cation exchange capacity of at least 30 meq/100g.

The silicate ion exchanger is preferably a smectitic clay mineral, an attapulgite or a natural or synthetic zeolite (preferred mean diameter 2 to 6 m). The clay mineral used is preferably a mineral from the montmorillonite/beidellite series, in particular bentonite, hectorite, saponite, nontronite or a corresponding acid-activated mineral. Acid-activated bentonite is most preferably used. The acid activation causes an increase in the specific surface area, thus improving the sorption capacity of the silicate ion exchanger.

The acid-activation of smectitic clay minerals and atapulgite can be carried out as described below.

Naturally occurring alkali metal and/or alkaline earth metal bentonites having a silicate layer structure, montmorillonite contents of from about 60 to 100 weight percent, preferably from about 70 to about 90 weight percent, cation exchange capacities of from about 50 to about 100 meq/100 and specific surfaces of from about 30 to about 80 $m^2$/ g are slurried in water applying a high shearing force. Sufficient water is used to obtain a slurry having a solids content of about 10 to about 50 weight percent, preferably about 25 to about 35 weight percent. Course impurities are removed over a 1 mm seive. Further purification can be conducted via centrifugation or hydrocylone steps so as to increase the montmorillonite content to at least about 80 weight percent.

The slurried material is then acid-activated using, preferably, mineral acids, i.e., hydrochloric acid, sulfuric acid or phosphoric acid.

The acid treatment is conducted under conditions that ensure the formation of excess $SiO_2$ at the surface of the clay mineral. This is generally accomplished when the aluminum is dissolved from the octahedral layer of the clay mineral. The acid is used in excess over the ion exchange capacity of the clay, generally in the amount of about 10 to about 100 parts by weight per 100 parts by weight of clay. Preferably, about 10 to about 40 parts by weight of hydrochloric acid, or about 25 to about 90 parts by weight of sulfuric acid are used per 100 parts by weight of clay. The acids can be used in concentrated form or can be diluted with water down to about 10 percent by weight. The acid-activation can be conducted at room temperature up to about 150° C. Preferably, in order to reduce reaction time, the reaction is conducted from about 80° C. to about 150° C., using super-atmosphere pressure when necessary to obtain the higher temperatures. The time for acid activation to take place can be as short as 15 minutes (at 150° C. and super atmospheric-pressure) to as long as 16 hours depending on the temperature, the amount and concentration of the acid. The acid-activated clay is washed with water to remove free acid. The excess washing solution is removed by filtration. The wet filter cake, having a moisture content as high as about 65 weight percent, can then be reacted with an alkali metal carbonate or hydrogen carbonate. Alternatively, the washed acid-activated clay can be dried to a moisture content as low as about 8 weight percent and then can be reacted with the carbonate or hydrogen carbonate.

The reaction between the acid-activated bentonite and the alkali metal carbonate or hydrogen carbonate is conducted by thoroughly mixing the two components together. This reaction can be conducted, for example, by kneading the components together in a Werner-Pfleiders type kneader or by using an extruder. About 1 to about 70 weight percent alkali metal carbonate or alkali metal hydrogen carbonate, preferably about 5 to about 50 weight percent, is reacted with the clay mineral wherein said weight percents are based on the total weight of clay and carbonate or hydrogen carbonate.

Although not wishing to be bound by theory, a possible mechanism for the acid activation and subsequent alkali metal carbonate or hydrogen carbonate reaction is as follows. Montmorillonite and similar clay minerals have a three layer structure. A central octahedral layer containing Al, Mg and Fe cations is sandwiched between two tetrahedral layers with Si and Al as central atoms. The octahedral and tetrahedral layers are separated by an intermediate layer which contains the exchangeable cation (e.g., sodium and calcium ions) and water. In the acid activation process, the cations in the intermediate layers are replaced by hydrogen atoms first. Upon further acid activation, part of the a octahedral layer, e.g., the Al ion, is dissolved. A large part of the iron ions in the octahedral layer that can cause decomposition of hydrogen peroxide is also removed. The acid activated bentonite consists of a residual layer structure with covalently bound $SiO_4$ tetrahedra at the edges and corners of the lattice.

In the acid activated clay-alkali metal carbonate or hydrogen carbonate reaction, the $SiO_4$ tetrahedra at the edges and corners of the acid activated bentonite are converted into an alkali metal silicate structure (water glass structure) that is not completely free but is still bound to the $SiO_4$ tetrahedral structure of the lattice. This "bound water glass structure" appears to stabilize hydrogen peroxide better than "free water glass." This is probably due to the fact that the expanded lattice of the acid-activated clay mineral also has an adsorptive capacity towards iron heavy metal ions.

The "bound water glass" when in contact with water, has a a lower pH than "free water glass" which is also a peroxide-stabilizing factor.

As a result of the reaction with the alkali metal carbonate or alkali metal hydrogen carbonate, the specific surface area of the product is reduced to about 30 to about 100m $^2$/g. The degree of surface area reduction and the efficiency of the "water glass depot" can be controlled by varying the proportion of alkali metal carbonate or hydrogen carbonate.

The zeolites used in the present invention are not acid activated because the zeolites have a high $SiO_2$ content which, in view of the wide lattice structure of zeolites, is readily "approachable" by the alkali metal carbonate or hydrogen carbonates which result in the formation of "face bound water glass. This acts as a water glass depot like the "bound water glass" in the acid activated smectitic clay minerals.

The modified zeolites can be produced by using the following procedure.

A zeolite, preferably having a $SiO_2/Al_2O_3$ molar ratio of more than about 1.8, is wetted with or slurried in water, the amount of water being in general no more than about 50 percent of the total weight of water and zeolite. The wet zeolite is then thoroughly mixed with the alkali metal carbonate or hydrogen carbonate, preferably sodium bicarbonate, in the proportions used for the acid-activated clay mineral.

In a specific example, a 50 percent by weight aqueous dispersion of zeolite was mixed with sodium bicarbonate in a weight ratio of 2:1 at room temperature with a conventional stirrer. A surfactant was added to reduce sedimentation.

In another example, a spay dried zeolite was dry mixed with sodium bicarbonate in a weight ratio of 2:1. The mixture was added to the bleaching solution where the sodium bicarbonate acted in situ with the zeolite to form a water glass depot.

The invention also relates to a bleaching agent for chemical pulp, mechanical pulp, waste paper and/or mixtures thereof, containing hydrogen peroxide and optionally water glass, alkali metal hydroxide and/or a complexing agent, which is characterized in that it contains an additive as defined above. The hydrogen peroxide is added to and mixed with the alkali metal carbonate or hydrogen carbonate reacted acid-activated clay mineral or zeolite additive which is then used in the bleaching process. Alternatively, the additive is added to the pulp followed by the addition of hydrogen peroxide.

The bleaching agent according to the invention preferably contains 20 to 300, in particular 30 to 200, g of additive per mole of hydrogen peroxide. About 0.5 to about 5 weight percent hydrogen peroxide, preferably about 1 to about 3 weight percent, is used in the bleaching process, said weight percent being based on the weight of pulp.

The invention furthermore relates to a process for bleaching chemical pulp, mechanical pulp, waste paper and/or mixtures thereof, where the substances to be bleached are treated with a bleaching agent containing hydrogen peroxide and optionally alkali metal hydroxide, water glass and/or a complexing agent; this process is characterized in that the treatment with a bleaching agent as defined above is carried out at a pH of from 7.0 to 12.0, in particular 7.5 to 9.0.

It is thus possible to carry out the bleaching in a slightly alkaline medium, thereby reducing the difficulties which occur if a large amount of alkali or water glass is added.

The bleaching of chemical pulp, mechanical pulp, waste paper and/or mixtures thereof is described in detail in Kirk-Othmer, "Encyclopedia of Chemical Technology", 2nd Ed., Vol 16, pages 724–727, Interscience Publishers (1968), which is hereby incorporated by reference.

The invention is described by the examples below.

1 General experimental procedures 1.1 Mechanical pulp bleaching

The bleaching chemicals were added to 50 g of absolute dry groundwood at a stock consistency of 25 percent by weight with exclusion of air. After adjusting the stock consistency to 20 percent by weight, the mixture was homogenized and bleached for 2 hours on a waterbath with occasional mixing at a bath temperature of 70° C. The bleached mechanical pulp was diluted with distilled water to about 0.5 to 1 percent by weight, disintegrated, filtered off with suction in a laboratory suction filter and dried in a sheet former. The brightness of the sheets formed was determined in an Elrephomat (reflectance R at 457 nm).

1.2 Waste paper bleaching/flotation deinking

The waste paper (newspapers or newspapers/magazines 50:50) were aged at 60° C. for 144 hours and subsequently conditioned for at least 24 hours at 23° C. and a relative atmospheric humidity of 50 percent. After the bleaching and flotation chemicals had been added, the waste paper was disintegrated for 5 minutes at a rotor speed of $3000^{-1}$ min at a stock consistency of 4 percent by weight in water adjusted to a defined hardness using $Ca(OH)_2$ or $Ca\ Cl_2$ at 40° C. After a 90 minute reaction phase at 40° C., breaking down was carried out for a further 2 minutes at a stock consistency of 3.5 percent by weight. The material was subsequently diluted to a stock consistency of 0.8 percent by weight, transferred into a laboratory flotation cell and floated for 15 minutes at a stirrer speed of 1200 min$^{-}$while introducing 60 liters/h of air. After the pH of the accepted stock suspension had been adjusted to 5, sample sheets were formed on porcelain suction filters and dried at about 90° C. and conditioned. The brightness was measured (R 457) as above in an Elrepho or Elrephomat.

1.3 Chemical pulp bleaching

For use, for example, in newspaper printing paper and in other printing papers and in some packaging materials, it is sufficient for the sulfite pulp to have moderate purity at brightnesses of from 60 to 75. This aim is achieved using one-step peroxide bleaching. Besides the simple handling, the advantage of peroxide bleaching is that the yield remains very high.

The bleaching chemicals and the ion exchanger (AAB containing various amounts of sodium carbonate; cf. Table 7) were added to 50 g of absolute dry chemical pulp at a stock consistency of 12 percent by weight with exclusion of air. After homogenization, bleaching was carried out for 2 hours on a waterbath at a bath temperature of 70° C. with occasional mixing. The bleached chemical pulp was diluted with distilled water to about 0.5 to 1 percent by weight, disintegrated, filtered with suction in a laboratory suction filter and dried in a sheet former. The brightness of the formed sheets was determined in an Elrephomat (R 457).

2 Results 2.1 Mechanical pulp bleaching (Table 1)

Examples 1 to 32 show the results of mechanical pulp bleaching experiments, expressed as R 457 values, which describe the difference in brightness between bleached pulp and the initial pulp.

The ion exchanger used was a zeolite A type, modified with 5 percent of $Na_2CO_3$.

2.1.1 Experiments without DPTA (No. 1–11)

Experiment 1 documents the loss in brightness due to alkali yellowing compared with the initial pulp. Experiments 2–8 show the results on the use of water glass, the ion exchanger modified according to the invention and mixtures of the two; combinations such as in Experiment 7 or, in Experiment 8 have thus proven particularly favorable. Experiments 1–8 were carried out with addition of 0.5 percent of NaOH so that the pH established was always 10 to 12. An additional small amount of NaOH is frequently expedient if using an acid mechanical pulp.

The advantages of the ion exchanger modified according to the invention become particularly clear if no NaOH is added (Experiments 9 to 11; pH 8–9). In the mechanical pulp samples of Experiments 9 to 11, no subsequent alkali yellowing was recorded, whereas the samples of Experiments 1 to 8 exhibited COD values of from 800 to 1100 mg $O_2$/liter, while the filtrate of samples 9 to 11 exhibited COD values of only 600 to 800 mg $O_2$/liter.

2.1.2 Experiments using DTPA (No. 12–32)

Experiments 12 to 23 were carried out under highly alkaline conditions. The best results were again produced by a mixture of a little water glass with the ion exchanger modified according to the invention (No. 20 to 22). Under slightly alkaline conditions —without addition of NaOH—the ion exchanger modified according to the invention gives better results than water glass, and these results could not be improved further even by admixing water glass (Experiments 31 and 32).

2.2 Waste paper bleaching (Tables 2 to 6)

Table 2 (Experiments 1 to 14) shows the dependency of the flotation deinking result on the water hardness and on the hydrogen peroxide stabilizer. Irrespective of the waste paper stock—only newspapers (N) or newspapers/magazines 1/1 (N/M)— the result using the ion exchanger modified according to the invention (acid-activated bentonite, modified using 25 percent of $Na_2CO_3$) was always better than the result obtained using water glass.

Experiments 15 to 22 shown in Table 3, heavy metal ions ($CU^{2+}$, $Fe^{3+}$, $Mn^{2+}$and $Cd^{2+}$) were added to the waste paper. stock (newspapers/magazines 1/1) at a water hardness of 100° (German). When using the same amount, the ion exchanger according to the invention again produced better results than an addition of water glass.

The pH of the flotation medium was 9 to 12. The flotation was carried out as described in 1.2.

Table 4 shows the results of Experiments 23 to 29. Experiments 23, 24 and 29 were carried out using newspapers and magazines 1/1 only with water glass, only with modified, acid-activated bentonite or only with the organic complexing agent DTPA. Experiments 25 to 28 show a synergism in the action between ion exchanger and DTPA, so that no loss in action occurred even when 90 percent of the DTPA was replaced by the ion exchanger according to the invention (Experiment 25).

In Experiments 30 to 34 shown in Table 5, water glass was replaced in steps by the ion exchanger according to the invention (acid-activated bentonite AAB), significant increases in brightness being observed.

The results of Experiments 25 to 40 show that addition of 1.5 percent by weight of ion exchanger can be regarded as equivalent to the use of 3 percent by weight of water glass (Experiments 35 and 38). A further improvement was achieved here by reducing the NaOH concentration (Experiment 39).

In Experiments 41 to 56 shown in Table 6, a waste paper was used in the form of newspapers (Experiments 41 to 48) and the water hardness, the NaOH concentration and the amount of ion exchanger employed were varied. The ion exchanger used was (AAB), which had been modified using 25 percent of $Na_2CO_3$ or 25 percent of $NaHCO_3$. At a water hardness of 100° (German), 2 percent of the ion exchanger according to the invention along with 1 percent of NaOH produced the same result as 3 percent of ion exchanger and 2 percent of NaOH. Both experiments (42 and 43) produced better results than the comparative experiment (41) using water glass.

As expected, the brightness was improved by reducing the water hardness (Experiments 44 to 48). The best result of this series was achieved using the ion exchanger according to the invention, modified using 25 percent of $NaHCO_3$, and adjusting the pH to 7.5 (Experiment 48).

In Experiments 49 to 56, waste paper in the form of a 50/50 mixture of newspapers and magazines was used. The water hardness was 20° German). The amount of water glass, ion exchanger (here based on zeolite, modified with NaHC03), DTPA and NaOH were varied.

It is worthy of note that the result of standard experiment 50 (3 percent of water glass, 0.3 percent of DTPA, 2 percent of NaOH) was equalled in Experiment 52 (3 percent of ion exchanger, no DTPA no NaOH).

2.3 Chemical pulp bleaching (Table 7)

The investigation results show that replacement of water glass by the modified, inorganic ion exchanger produces increases in brightness.

TABLE 1

| | | | Groundwood bleaching | | | |
|---|---|---|---|---|---|---|
| Exp. No. | $H_2O_2$ % by weight | DTPA % by weight | Water glass % by weight | Ion exchanger (inv.) containing 5% of $Na_2CO_3$ % by weight | NaOH % by weight | Brightness difference ΔR 457 % |
| 1 | 1 | 0 | 0 | 0 | 0.5 | −2.6 |
| 2 | 1 | 0 | 1 | 0 | 0.5 | 5.3 |
| 3 | 1 | 0 | 2 | 0 | 0.5 | 7.3 |
| 4 | 1 | 0 | 0 | 3 | 0.5 | 1.9 |
| 5 | 1 | 0 | 0 | 5 | 0.5 | 5.2 |
| 6 | 1 | 0 | 0.5 | 3 | 0.5 | 6.5 |
| 7 | 1 | 0 | 1 | 3 | 0.5 | 8.0 |
| 8 | 1 | 0 | 1 | 1.5 | 0.5 | 6.8 |
| 9 | 1 | 0 | 0 | 3 | 0 | 7.0 |
| 10 | 1 | 0 | 1 | 3 | 0 | 7.8 |
| 11 | 1 | 0 | 2 | 3 | 0 | 8.6 |
| 12 | 1 | 0.25 | 0 | 0 | 0.5 | 1.5 |
| 13 | 1 | 0.25 | 1 | 0 | 0.5 | 6.5 |
| 14 | 1 | 0.25 | 1.5 | 0 | 0.5 | 9.2 |
| 15 | 1 | 0.25 | 2 | 0 | 0.5 | 9.1 |
| 16 | 1 | 0.25 | 3 | 0 | 0.5 | 9.3 |
| 17 | 1 | 0.25 | 0 | 1 | 0.5 | 4.3 |
| 18 | 1 | 0.25 | 0 | 2 | 0.5 | 6.1 |
| 19 | 1 | 0.25 | 0 | 3 | 0.5 | 6.9 |
| 20 | 1 | 0.25 | 1 | 3 | 0.5 | 10.0 |
| 21 | 1 | 0.25 | 1.5 | 3 | 0.5 | 9.8 |
| 22 | 1 | 0.25 | 2 | 3 | 0.5 | 10.4 |
| 23 | 1 | 0.25 | 3 | 3 | 0.5 | 10.0 |
| 24 | 1 | 0.25 | 0 | 0 | 0 | 2.2 |
| 25 | 1 | 0.25 | 1 | 0 | 0 | 5.3 |
| 26 | 1 | 0.25 | 2 | 0 | 0 | 7.2 |
| 27 | 1 | 0.25 | 0 | 1 | 0 | 8.1 |
| 28 | 1 | 0.25 | 0 | 2 | 0 | 8.5 |
| 29 | 1 | 0.25 | 0 | 3 | 0 | 8.5 |

TABLE 1-continued

| Exp. No. | $H_2O_2$ % by weight | DTPA % by weight | Groundwood bleaching: Water glass % by weight | Ion exchanger (inv.) containing 5% of $Na_2CO_3$ % by weight | NaOH % by weight | Brightness difference ΔR 457 % |
|---|---|---|---|---|---|---|
| 30 | 1 | 0.25 | 0 | 6 | 0 | 8.0 |
| 31 | 1 | 0.25 | 1 | 3 | 0 | 8.5 |
| 32 | 1 | 0.25 | 2 | 3 | 0 | 8.3 |

TABLE 2

Flotation deinking of waste paper, dependency on the water hardness

| Exp. No. | WP stock | $H_2O_2$ | Soap | NaOH % by weight | Water glass % by wt | Ion exchanger % by weight | Water hardness ° (German) | Brightness R 457 % |
|---|---|---|---|---|---|---|---|---|
| 1 | N | 1 | 1 | 2 | 3 | 0 | 14 | 48.7 |
| 2 | N | 1 | 1 | 2 | 3 | 0 | 30 | 48.9 |
| 3 | N | 1 | 1 | 2 | 3 | 0 | 50 | 45.8 |
| 4 | N | 1 | 1 | 2 | 3 | 0 | 100 | 43.2 |
| 5 | N | 1 | 1 | 2 | 0 | 3 | 14 | 49.1 |
| 6 | N | 1 | 1 | 2 | 0 | 3 | 30 | 49.7 |
| 7 | N | 1 | 1 | 2 | 0 | 3 | 50 | 47.5 |
| 8 | N | 1 | 1 | 2 | 0 | 3 | 100 | 45.1 |
| 9 | N | 1 | 1 | 2 | 3 | 0 | 30 | 52.3 |
| 10 | N/M | 1 | 1 | 1 | 3 | 0 | 50 | 50.2 |
| 11 | N/M | 1 | 1 | 2 | 3 | 0 | 100 | 47.1 |
| 12 | N/M | 1 | 1 | 2 | 0 | 3 | 30 | 52.6 |
| 13 | N/M | 1 | 1 | 2 | 0 | 3 | 50 | 52.1 |
| 14 | N/M | 1 | 1 | 2 | 0 | 3 | 100 | 47.3 |

TABLE 3

Flotation deinking of waste paper
WP stock: newspapers/magazines 1/1; addition of heavy-metal ions

| Exp. No. | $H_2O_2$ % by weight | Soap | NaOH % by weight | Water glass % by weight | Ion exchanger % by weight | Water hardness ° (German) | Metal ions type/amount % | Brightness R 457 % |
|---|---|---|---|---|---|---|---|---|
| 15 | 1 | 1 | 2 | 3 | 0 | 100 | $Cu^{2+}$ 0.02 | 48.3 |
| 16 | 1 | 1 | 2 | 0 | 3 | 100 | $Cu^{2+}$ 0.02 | 49.3 |
| 17 | 1 | 1 | 2 | 3 | 0 | 100 | $Fe^{3+}$ 0.02 | 47.0 |
| 18 | 1 | 1 | 2 | 0 | 3 | 100 | $Fe^{3+}$ 0.02 | 48.4 |
| 19 | 1 | 1 | 2 | 3 | 0 | 100 | $Mn^{2+}$ 0.02 | 46.9 |
| 20 | 1 | 1 | 2 | 0 | 3 | 100 | $Mn^{2+}$ 0.02 | 47.5 |
| 21 | 1 | 1 | 2 | 3 | 0 | 100 | $Cd^{2+}$ 0.02 | 49.8 |
| 22 | 1 | 1 | 2 | 0 | 3 | 100 | $Mn^{2+}$ 0.02 | 50.1 |

TABLE 4

Flotation deinking of waste paper (newspapers/magazines 1/1)

| Exp. No. | $H_2O_2$ % | Soap % | NaOH % | Water hardness ° (German) | Water glass % | Ion exchanger % | DTPA % | Brightness R 457 % | COD kg/t of pulp | mg/l |
|---|---|---|---|---|---|---|---|---|---|---|
| 23 | 1 | 1 | 2 | 100 | 3 | 0 | 0 | 45.8 | 24.3 | 142 |
| 24 | 1 | 1 | 2 | 100 | 0 | 3 | 0 | 46.9 | 23.5 | 111 |
| 25 | 1 | 1 | 2 | 100 | 0 | 2.7 | 0.3 | 49.6 | 32.4 | 202 |
| 26 | 1 | 1 | 2 | 100 | 0 | 2.4 | 0.6 | 49.4 | 36.5 | 230 |
| 27 | 1 | 1 | 2 | 100 | 0 | 1.5 | 1.5 | 49.9 | 47.5 | 275 |
| 28 | 1 | 1 | 2 | 100 | 0 | 0.75 | 2.25 | 50.0 | 39.7 | 249 |
| 29 | 1 | 1 | 2 | 100 | 0 | 0 | 3 | 49.6 | 44.5 | 247 |

TABLE 5

Flotation deinking of waste paper; WP stock: newspapers/magazines 1/1

| Exp. No. | $H_2O_2$ % | Soap % | NaOH % | Water hardness ° (German) | Water glass % | Ion exchanger % | DTPA % | Brightness R 457 % |
|---|---|---|---|---|---|---|---|---|
| 30 | 1 | 1 | 2 | 100 | 3 | 0 | 0 | 44.6 |
| 31 | 1 | 1 | 2 | 100 | 2 | 1 | 0 | 45.5 |
| 32 | 1 | 1 | 2 | 100 | 1.5 | 1.5 | 0 | 45.6 |
| 33 | 1 | 1 | 2 | 100 | 1 | 2 | 0 | 46.5 |
| 34 | 1 | 1 | 2 | 100 | 0 | 3 | 0 | 48.8 |
| 35 | 1 | 1 | 2 | 100 | 3 | 0 | 0.2 | 50.4 |
| 36 | 1 | 1 | 2 | 100 | 0 | 3 | 0.2 | 51.9 |
| 37 | 1 | 1 | 2 | 100 | 0 | 2 | 0.2 | 50.8 |

TABLE 5-continued

| Flotation deinking of waste paper; WP stock: newspapers/magazines 1/1 | | | | | | | | |
|---|---|---|---|---|---|---|---|---|
| Exp. No. | $H_2O_2$ % | Soap % | NaOH % | Water hardness ° (German) | Water glass % | Ion exchanger % | DTPA % | Brightness R 457 % |
| 38 | 1 | 1 | 2 | 100 | 0 | 1.5 | 0.2 | 50.0 |
| 39 | 1 | 1 | 1 | 100 | 0 | 1.5 | 0.2 | 50.7 |
| 40 | 1 | 1 | 2 | 100 | 0 | 1 | 0.2 | 49.2 |

TABLE 6

| Flotation deinking of waste paper | | | | | | | | | | | | |
|---|---|---|---|---|---|---|---|---|---|---|---|---|
| Exp. No. | WP stock | $H_2O_2$ % by weight | Soap % | NaOH % | pH | Water hardness ° (German) | Water glass % | Ion exchanger % | Ion exchanger Type | Ion exchanger Mod. with | DTPA % | Brightness R 457 % |
| 41 | N | 1 | 1 | 2 | 11.1 | 100 | 3 | 0 | AAB | | 0.2 | 43.8 |
| 42 | N | 1 | 1 | 2 | 11.0 | 100 | 0 | 3 | " | $Na_2CO_3$ (25%) | 0.2 | 45.4 |
| 43 | N | 1 | 1 | 1 | 10.0 | 100 | 0 | 1.5 | " | $Na_2CO_3$ (25%) | 0.2 | 45.5 |
| 44 | N | 1 | 1 | 2 | 11.2 | 50 | 3 | 0 | " | | 0.2 | 47.3 |
| 45 | N | 1 | 1 | 2 | 11.0 | 50 | 0 | 3 | " | $Na_2CO_3$ (25%) | 0.2 | 50.4 |
| 46 | N | 1 | 1 | 1 | 10.0 | 50 | 0 | 1.5 | " | $Na_2CO_3$ (25%) | 0.2 | 51.1 |
| 47 | N | 1 | 1 | 2 | 11.1 | 50 | 0 | 3 | " | $NaHCO_3$ (25%) | 0.2 | 50.3 |
| 48 | N | 1 | 1 | 2 | 7.5 | 50 | 0 | 3 | " | $NaHCO_3$ (25%) | 0.2 | 51.8 |
| 49 | N/M | 1 | 1 | 2 | 11.0 | 20 | 3 | 0 | " | | 0 | 48.6 |
| 50 | N/M | 1 | 1 | 2 | 11.1 | 20 | 3 | 0 | Z | | 0.3 | 49.5 |
| 51 | N/M | 1 | 1 | 0 | 9.6 | 20 | 3 | 2.5 | " | $NaHCO_3$ (60%) | 0 | 50.0 |
| 52 | N/M | 1 | 1 | 0 | 9.2 | 20 | 0 | 3 | " | $NaHCO_3$ (50%) | 0 | 49.5 |
| 53 | N/M | 1 | 1 | 1 | 10.5 | 20 | 1 | 3.5 | Z | $NaHCO_3$ (57%) | 0 | 49.6 |
| 54 | N/M | 1 | 1 | 0 | 9.0 | 20 | 0 | 4 | " | $NaHCO_3$ (50%) | 0 | 49.4 |
| 55 | N/M | 1 | 1 | 0 | 7.9 | 20 | 0 | 4 | " | $NaHCO_3$ (50%) | 0 | 48.9 |
| 56 | N/M | 1 | 1 | 0 | 9.2 | 20 | 0 | 4 | " | $NaHCO_3$ (50%) | 0.3 | 49.9 |

AAB = acid-activated bentonite
Z = zeolite

TABLE 7

| Chemical pulp bleaching | | | | | | |
|---|---|---|---|---|---|---|
| Exp. No. | $H_2O_2$ % by weight | DTPA % by weight | Water glass % by weight | Ion exchanger (inv.) with 5% $Na_2CO_3$ % by weight | NaOH % by weight | Brightness difference ΔR 457 % |
| 1 | 2 | 0.25 | 0 | 0 | 1.0 | −2.2 |
| 2 | 2 | 0.25 | 1 | 0 | 1.0 | 2.8 |
| 3 | 2 | 0.25 | 2 | 0 | 1.0 | 3.9 |
| 4 | 2 | 0.25 | 3 | 0 | 1.0 | 4.5 |
| 5 | 2 | 0.25 | 0 | 3 | 1.0 | 4.7 |
| 6 | 2 | 0.25 | 1 | 2 | 1.0 | 6.8 |
| 7 | 2 | 0.25 | 2 | 1 | 1.0 | 5.8 |
| 8 | 2 | 0.25 | 1 | 2 | 0 | −2.3 |
| 9 | 2 | 0.25 | 1 | 2 | 0.5 | 5.8 |
| 10 | 2 | 0.25 | 1 | 2 | 1.0 | 6.8 |

What is claimed:

1. In a process for bleaching chemical pulp, mechanical pulp, waste paper, or mixtures thereof, the improvement which comprises conducting the process at a pH of about 7 to about 12 using as the bleaching agent (a) an additive comprising a water-insoluble silicate ion exchanger, selected from the group consisting of acid-activated smectitic clay minerals, acid-activated atapulgite, and natural or synthetic zeolites, said silicate ion exchanger having been modified with an alkali metal carbonate or an alkali metal hydrogen carbonate in the amount of from 1 to about 70 weight percent based on the total weight of the additive, and (b) hydrogen peroxide.

2. The process of claim 1 wherein the amount of alkali metal carbonate or alkali metal hydrogen carbonate is about 5 to about 50 weight percent.

3. The process of claim 1 wherein the modified silicate ion exchanger has a BET surface area of at least about 30 $m^2/g$ and a cation exchange capacity of at least 30 meq./100g.

4. The process of claim 1 wherein the acid-activated smectitic clay mineral is an acid-activated mineral from the montmorrilonite/beidellite series.

5. The process of claim 4 wherein the mineral is bentonite, hectorite, saponite, or nontronite.

6. The process of claim 1 wherein about 20 to about 300 grams of additive are present per mole of hydrogen peroxide.

7. The process of claim 6 wherein about 30 to about 200 grams of additive are present per mole of hydrogen peroxide.

8. The process of claim 1 wherein the bleaching agent further contains water glass, or alkali metal hydroxide, or a complexing agent or mixtures thereof.

9. The process of claim 1 wherein the pH is about 7.5 to about 9.

* * * * *